US008668841B2

(12) United States Patent
Hansen

(10) Patent No.: US 8,668,841 B2
(45) Date of Patent: Mar. 11, 2014

(54) BISMUTH-ZINC-MERCURY AMALGAM, FLUORESCENT LAMPS, AND RELATED METHODS

(75) Inventor: Steven C. Hansen, Urbana, IL (US)

(73) Assignee: Advanced Lighting Technologies, Inc., Solon, OH (US)

( * ) Notice: Subject to any disclaimer, the term of this patent is extended or adjusted under 35 U.S.C. 154(b) by 1047 days.

(21) Appl. No.: 11/808,573

(22) Filed: Jun. 11, 2007

(65) Prior Publication Data

US 2008/0001519 A1 Jan. 3, 2008

Related U.S. Application Data

(60) Provisional application No. 60/812,122, filed on Jun. 9, 2006.

(51) Int. Cl.

| | |
|---|---|
| ***H01J 7/18*** | (2006.01) |
| ***H01K 1/56*** | (2006.01) |
| ***C22C 18/00*** | (2006.01) |
| ***C22C 12/00*** | (2006.01) |

(52) U.S. Cl.
USPC ..... 252/181.6; 252/181.1; 445/9; 420/513; 420/577

(58) Field of Classification Search
USPC ..... 252/181.1, 181.6; 420/513, 577; 445/9
See application file for complete search history.

(56) References Cited

U.S. PATENT DOCUMENTS

| | | | | |
|---|---|---|---|---|
| 4,145,634 | A | 3/1979 | Evans et al. | |
| 4,216,178 | A | 8/1980 | Anderson | |
| 4,615,846 | A * | 10/1986 | Yoshino et al. | 264/13 |
| 5,882,237 | A | 3/1999 | Sarver et al. | |
| 6,339,287 | B1 | 1/2002 | Sarver et al. | |
| 6,734,616 | B2 * | 5/2004 | Lankhorst et al. | 313/490 |
| 6,791,254 | B2 | 9/2004 | Stafford et al. | |
| 2001/0038264 | A1 * | 11/2001 | Brumleve et al. | 313/565 |

OTHER PUBLICATIONS

"spheroidal" from Merriam-Webster Online, Dec. 4, 2009 <http://www.merriam-webster.com/dictionary/Spheroidal>.*

T.R. Brumleve, S.C. Hansen and L.G. Kaczorowski, "Zn-Hg Amalgams for Fluorescent Lamps: Vapor Pressure, Thermodynamics and Lamp Performance", Proc. Electrochem. Soc., High Temperature Lamp Chemistry III, ed. by J.M. Ranish and C.W. Struck, 93 (16) 235-256 (1993).

T.R. Brumleve, S.C. Hansen, P.W. Lehigh, D.A. Stafford and K.S. Wilcox, "Quantitative Measurement of the Evaporation and Absorption of Mercury from Zn-Hg Fluorescent Lamp Amalgams", J. Light and Visual Environment, 23, 1-9 (1999).

D.L. Miller, R.L. Steward and T.R. Brumleve, "Determination of Water Contaminatin in Zinc Mercury Fluorescent Lamp Dose Pellets by Thermal Evolution Infrared Absorption Spectroscopy", 9th Intl. Symposium on the Science and Technology of Light Sources, LS:9, Cornell University, Ithaca, NY (2001), pp. 153-154.

S.C. Hansen, "Thermodynamic Assessment of Binary Zn-Hg, Cd-Hg and In-Hg Amalgams", CALPHAD, 22, 359-73 (1998).

S.C. Hansen and T.R. Brumleve, TN-101, "Determination of Available Mercury in Zn-Hg Amalgam Spheres", Jun. 29, 1995, available from APL Engineered Materials.

M.V. Nosek, "Bi-Zn-Hg Diagrams", Izvestiya Akademii Nauk Kazakhoskoi SSR, Seriya Khimicheskaya, pp. 64-65 (1980).

N.M. Atamanova, M.V. Nosek and B.T. Asanova, "Liquidus Projection of the System Bi-Hg-An", Izvestiya Akademii Nauk Kazakhskoi SSR, Seriya Himicheskaya, (2), pp. 55-57 (1980).

M.V. Nosek, N.M. Atamanova and B.T. Asanova, "The Bi-Zn-Hg Phase Diagram", Russian Metallurgy, Translated from Izvestiya Akademii. Nauk SSR, Metally, (3), pp. 192-194 (1982).

N.M. Atamanova and M.V. Nosek, "Phase Diagram of the Ternary System Zn-Bi-Hg", Izvestiya Akademii Nauk Kazakhsko SSR, Seriya Khimicheskaya, (6), pp. 9-14 (1984).

* cited by examiner

*Primary Examiner* — Peter F Godenschwager
(74) *Attorney, Agent, or Firm* — Duane Morris LLP

(57) ABSTRACT

A pellet having a microstructure including a bismuth phase, a zinc solid solution phase, and a $Zn_3Hg$ phase is disclosed. A method of making a pellet including bismuth, zinc, and mercury is also disclosed. Moreover, a fluorescent lamp with a fill material including bismuth, zinc, and mercury is disclosed. Further, a method of dosing a fluorescent lamp with mercury is disclosed.

8 Claims, 5 Drawing Sheets

Bi-Zn-Hg Vapor Pressure (35.2 wt % Hg)

BISMUTH-ZINC-MERCURY AMALGAM, FLUORESCENT LAMPS, AND RELATED METHODS

CROSS-REFERENCE TO RELATED APPLICATIONS

The disclosure claims the filing-date benefit of Provisional Application No. 60/812,122, filed Jun. 9, 2006, and incorporated herein in its entirety.

BACKGROUND

Conventional fluorescent lamps contain mercury which is vaporized during lamp operation. The mercury vapor atoms efficiently convert electrical energy to ultraviolet radiation with a wavelength of approximately 253.7 nm when the mercury vapor pressure is in the range of approximately $2\times10^{-3}$ to $2\times10^{-2}$ Torr (optimally about $6\times10^{-3}$ Torr). In turn, the ultraviolet radiation is absorbed by a phosphor coating on the interior of the lamp wall and converted to visible light.

The temperature of the coldest spot on the inner wall of the lamp when the lamp is operating is referred to as the "cold spot temperature." The cold spot temperature determines the mercury vapor pressure within the lamp. When a lamp containing only mercury operates with a cold spot temperature above about 40° C., the mercury vapor pressure will exceed the optimal value of $6\times10^{-3}$ Torr. As the temperature increases, the mercury vapor pressure increases and more of the ultraviolet radiation is self-absorbed by the mercury, thereby lowering the efficiency of the lamp and reducing its light output.

The mercury vapor pressure is maintained within the desired range either by controlling the cold spot temperature of the lamp ("temperature control") or by introducing other metallic elements into the lamp in the form of amalgams that maintain the mercury vapor pressure ("amalgam control"). Temperature-controlled fluorescent lamps generally operate with a cold spot temperature below about 75° C. (typically ranging from 20-75° C.) and preferably 40-60° C. Such lamps are generally referred to as "low temperature" fluorescent lamps.

Fluorescent lamps with cold spot temperatures above about 75° C. (including, but not limited to, certain types of small diameter, low wattage fluorescent lamps generally known as compact fluorescents) are amalgam-controlled in that they typically require two or more elements in addition to mercury which may be introduced into the lamp as solid ternary or multi-component amalgams. Such amalgam-controlled lamps rely on establishment of thermodynamic equilibrium for proper lamp operation (for example, see U.S. Pat. No. 4,145,634).

Conventional fluorescent lamps are dosed with liquid mercury or zinc-mercury amalgam. The mercury vapor pressure is adjusted by controlling the temperature of the lamps. The mercury in lamps containing a zinc-mercury amalgam is in a metastable, non-equilibrium state, in contrast to the condition predicted by an equilibrium phase diagram.

U.S. Pat. Nos. 5,882,237, 6,339,287, and 6,791,254, each incorporated herein by reference, disclose materials, methods, and lamps containing a binary zinc-mercury amalgam. Binary zinc-mercury amalgam pellets provide a solid mercury dose for temperature controlled fluorescent lamps. They eliminate excessive amounts of liquid mercury and are easily handled at temperatures below 40° C. They also provide methods of dosing a fluorescent lamp with mercury, providing accurate and reliable dosing of fluorescent lamps.

The disclosed prior art pellets are in a metastable non-equilibrium state. They have a zinc-rich outer portion and regions of mercury-rich amalgam in the central regions of the pellet. The saturated zinc amalgam provides a mercury vapor pressure that is approximately 95 percent of the vapor pressure of pure mercury.

However, binary zinc-mercury amalgams had several features that were not as desirable as expected. For example, the zinc-mercury amalgam pellets were often times spheroidal, but not substantially spherical. For example, conventional spheroidal pellets have numerous flat spots and high eccentricity (ratio of average major axis over average minor axis significantly greater than unity). The spheroidal pellets required more processing steps than substantially spherical pellets.

Recently, a zinc-tin-mercury amalgam has been developed that is rounder than binary zinc-mercury amalgams. Although the zinc-tin-mercury amalgam improves upon the shape of binary zinc-mercury amalgam, they have the disadvantage of being sensitive to heat and becoming self-agglomerating.

Binary zinc-mercury amalgam pellets also have the disadvantage of re-absorbing small amounts of mercury over a period of weeks or months. Normally the re-absorption of mercury is not harmful to the operation of the fluorescent lamp. However, it is desirable in industry that the re-absorption of mercury be minimized or eliminated.

Accordingly, there is a need in industry for technological solutions providing materials, devices, and methods to address concerns such as mercury re-absorption and amalgam pellet shape.

SUMMARY

A pellet is disclosed, the pellet having a microstructure comprising a bismuth solid solution phase, a zinc solid solution phase, and a $Zn_3Hg$ phase. In one embodiment, the pellet includes a mercury-rich intergranular phase. In another embodiment, the pellet includes a bismuth solid solution phase. In another embodiment, the pellet includes at least 45 weight percent bismuth. In another embodiment, the bismuth solid solution phase comprises less than 10 weight percent zinc. In another embodiment, the bismuth solid solution phase includes between about 45-50 weight percent bismuth, between about 45-50 weight percent mercury, and between about 0.5-5 weight percent zinc. In another embodiment, the zinc solid solution phase includes at least 75 weight percent zinc. In another embodiment, the zinc solid solution phase includes between about 75-95 weight percent zinc, between about 5-15 weight percent mercury, and between about 0.1-2 weight percent bismuth. In one embodiment, the pellet includes about 60 weight percent mercury. In another embodiment, the $Zn_3Hg$ phase includes between about 50-75 weight percent mercury, between about 25-35 weight percent zinc, and between about 0.5-3 weight percent bismuth. In another embodiment, the mercury-rich intergranular phase includes at least 75 weight percent mercury. In another embodiment, the pellet includes about 45 weight percent mercury, about 13.5 weight percent bismuth, and about 41.5 weight percent zinc. In another embodiment, the pellet includes about 35 weight percent mercury, about 8 weight percent bismuth, and about 57 weight percent zinc. In another embodiment, the pellet is substantially spherical. In another embodiment, the pellet includes approximately 0.5-90 weight percent bismuth, approximately 5-60 weight percent mercury, and approximately 10-80 weight percent zinc. In another embodiment, the pellet includes 30-45 weight percent mercury, 35-60 weight percent zinc, and 5-20 weight percent bismuth. In another embodiment, the pellet includes approximately 45 weight percent mercury, approximately 41 weight percent zinc, and approximately 14 weight percent bismuth. In another embodiment, the pellet includes approximately 45 weight percent mercury, approximately 41.5 weight percent zinc, and approximately 13.5 weight percent bismuth. In another embodiment, the pellet includes approximately 35 weight percent mercury, approximately 57 weight percent zinc, and approximately 8 weight percent bismuth. In another embodiment, the pellet includes approximately 35.2 weight percent mercury, approximately 57 weight percent zinc, and approximately 7.8 weight percent bismuth.

A pellet is disclosed, the pellet including bismuth, zinc, and mercury having a bismuth solid solution phase and a $Zn_3Hg$ phase, said phases being substantially uniformly distributed in the pellet. In one embodiment, the pellet is substantially spherical. In another embodiment, the pellet includes a zinc solid solution phase concentrated near the periphery of the pellet. In another embodiment, the pellet includes a mercury-rich phase concentrated in the inner portions of the pellet. In another embodiment, the pellet includes between about 0.5-90 weight percent bismuth, between about 5-60 weight percent mercury, and between about 10-80 weight percent zinc.

A substantially spherical pellet is disclosed, the pellet including bismuth, zinc, and mercury wherein the weight percent of bismuth is greater than 10.

A substantially spherical pellet is disclosed, the pellet including bismuth, zinc, mercury, and one or more elements from the group consisting of antimony, indium, tin, gallium, germanium, silicon, lead, copper, nickel, silver, gold, palladium, and platinum.

An amalgam of zinc and at least one other metal is disclosed, the amalgam having a weight percent ratio of mercury to zinc greater than 1.0. In another embodiment, the amalgam includes bismuth.

A plurality of generally spherical pellets formed from an amalgam is disclosed, the plurality containing zinc wherein the average eccentricity among the pellets is less than 1.05. In one embodiment, the average eccentricity among the pellets is about 1.015. In another embodiment, the amalgam includes bismuth.

An amalgam pellet for dosing mercury in a fluorescent lamp is disclosed, the pellet including mercury and an amalgamative metal that does not have a significant affect on the vapor pressure of the mercury, the amalgamative metal including zinc and at least 10 weight percent bismuth.

A generally spherical amalgam pellet is disclosed, the pellet including zinc and at least one other amalgamative metal having no more than about 15.0 weight percent mercury and having a diameter greater than about 0.5 mm. In one embodiment, the pellet has a diameter greater than about 1.0 mm. In another embodiment, the pellet has a diameter between about 1.2-1.7 mm. In another embodiment, the pellet has a diameter of about 1.5 mm. In another embodiment, the pellet has no more than about 5.0 weight percent mercury. In another embodiment, the pellet has no more than 1.0 weight percent mercury. In another embodiment, the pellet includes bismuth.

A fluorescent lamp containing a predetermined amount of mercury is disclosed, characterized in that the mercury is in the form of a solid bismuth zinc amalgam at room temperature, said amalgam comprising at least 10 weight percent bismuth.

A fluorescent lamp containing one or more amalgam pellets is disclosed, the pellets including a bismuth solid solution phase, a zinc solid solution phase, and a $Zn_3Hg$ phase.

A fluorescent lamp is disclosed, the lamp including a lamp fill material comprising bismuth, zinc, and mercury wherein the ratio of the weight of mercury to the weight of zinc contained in the lamp is greater than 1.0.

A fluorescent lamp is disclosed, the lamp containing an amalgam including bismuth, zinc, mercury, and one or more elements from the group consisting of antimony, indium, tin, gallium, germanium, silicon, lead, copper, nickel, silver, gold, palladium, and platinum.

A method of dosing a fluorescent lamp with mercury is disclosed, the method including introducing the mercury into the lamp in the form of an amalgam of zinc and at least 10 weight percent bismuth. In one embodiment, the amalgam includes between about 10-90 weight percent bismuth, between about 5-60 weight percent mercury, and between about 5-80 weight percent zinc. In another embodiment, the amalgam includes about 75 weight percent bismuth, about 12 weight percent zinc, and about 13 weight percent mercury. In another embodiment, the amalgam includes about 13.5 weight percent bismuth, about 41.5 weight percent zinc, and about 45 weight percent mercury. In another embodiment, the amalgam is in the form of one or more substantially spherical pellets when introduced into the lamp.

A method of dosing a fluorescent lamp with mercury comprising introducing one or more amalgam pellets into the lamp, at least one pellet comprising a bismuth solid solution phase, a zinc solid solution phase, and a $Zn_3Hg$ phase. In one embodiment, the at least one pellet includes a mercury-rich phase intergranular phase. In another embodiment, the bismuth solid solution phase and the $Zn_3Hg$ phase are substantially uniformly distributed in the at least one pellet. In another embodiment, the zinc solid solution phase is concentrated near the periphery of the at least one pellet. In another embodiment, the method includes a mercury-rich intergranular phase concentrated in the inner portions of the pellet. In another embodiment, the pellets are substantially spherical. In another embodiment, the lamp is a temperature controlled fluorescent lamp. In another embodiment, the amalgam includes between about 10-90 weight percent bismuth, between about 5-60 weight percent mercury, and between about 5-80 weight percent zinc. In another embodiment, the amalgam includes about 13.5 weight percent bismuth, about 41.5 weight percent zinc, and about 45 weight percent mercury. In another embodiment, the amalgam includes about 8 weight percent bismuth, about 57 weight percent zinc, and about 35 weight percent mercury. In another embodiment, the amalgam includes about 75 weight percent bismuth, about 12 weight percent zinc, and about 13 weight percent mercury.

A method of dosing a fluorescent lamp with mercury is disclosed, the method including introducing one or more bismuth zinc amalgam pellets into the lamp, the ratio of the weight of the mercury in the pellets to the weight of the zinc in the pellets being greater than 1.0.

A method of dosing a fluorescent lamp with mercury is disclosed, the method including introducing one or more pellets into the lamp comprising bismuth, zinc, mercury, and one or more elements from the group consisting of antimony, indium, tin, gallium, germanium, silicon, lead, copper, nickel, silver, gold, palladium, and platinum.

In a method of forming amalgam pellets containing between about 10-80 weight percent zinc having a generally spherical shape including the steps of melting zinc with mercury and rapidly quenching the melt to form generally spherical pellets, a method of improving the roundness of the pellets is disclosed, the method including the step of adding bismuth to the step of melting in an amount between about 0.5-90 weight percent of the melt.

A method of improving the roundness of a plurality of generally spherical amalgam pellets containing between about 10-80 weight percent zinc is disclosed, the method including adding between about 0.5-90 weight percent bismuth during formation of the pellet.

In a fluorescent lamp containing mercury that has been released from an amalgam containing zinc, a method of reducing the absorption of the mercury by the amalgam during operation of the lamp is disclosed, the method including adding bismuth to the amalgam.

Presently disclosed embodiments advantageously provide novel amalgams, novel pellet creation methods, novel lamp dosing methods, and novel fluorescent lamps containing a controlled amount of mercury. Various disclosed embodiments are directed to temperature-controlled fluorescent lamps, including temperature-controlled fluorescent lamps which contain mercury in the form of a bismuth-zinc amalgam.

Certain embodiments provide an amalgam with variable mercury contents. Other embodiments also provide an amalgam with variable bismuth contents. Various other embodiments also provide a solid mercury dose. Disclosed embodiments further improve the roundness of the mercury dose by using a bismuth-zinc amalgam.

A novel material is also disclosed which is less likely than binary zinc amalgam to re-absorb mercury within a fluorescent lamp. Various embodiments also provide an amalgam with a mercury vapor pressure similar to liquid mercury and to binary zinc-mercury amalgam. Also, certain embodiments advantageously provide a free-flowing amalgam.

These and many other features and advantages of the present disclosed embodiments will be readily apparent to one skilled in the art to which the disclosed embodiments pertain from a perusal of the claims, the appended drawings, and the following detailed description.

BRIEF DESCRIPTION OF THE DRAWINGS

Various aspects of the present disclosure will be or become apparent to one with skill in the art by reference to the following detailed description when considered in connection with the accompanying exemplary non-limiting embodiments, wherein.

DETAILED DESCRIPTION

Figure 1:
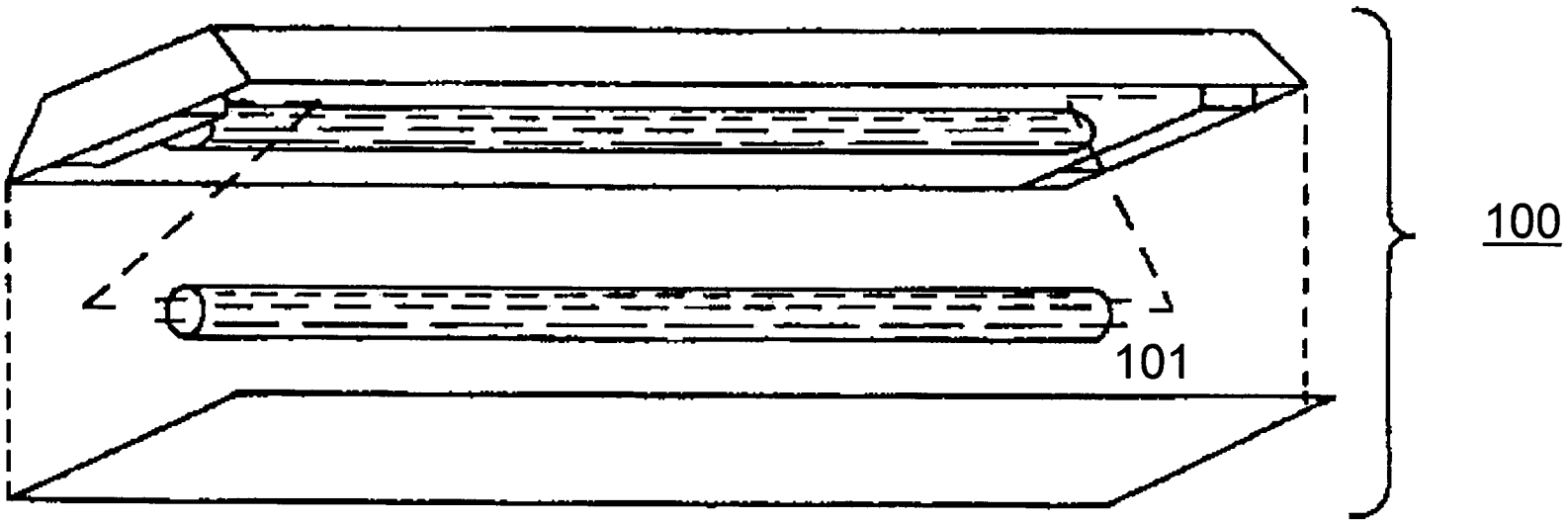
FIG. 1 is a pictorial view of an embodiment of a fluorescent lamp.

FIG. 1 illustrates an exemplary embodiment of a novel fluorescent lamp 101 according to the present disclosure. In one embodiment, the lamp is of standard size suitable for installation and use in conventional ceiling fixtures 100 and contains mercury in the form of a bismuth-zinc amalgam.

In one embodiment, the amalgam is ternary—that is, the amalgam includes zinc, bismuth, and mercury (and with such minor impurities as may be introduced in the manufacturing process). In other embodiments, the amalgam includes bismuth, zinc, and mercury with a portion (for example, less than 40 weight percent) of other materials as may be appropriate (including, but not limited to, antimony, indium, tin, gallium, germanium, silicon, lead, copper, nickel, silver, gold, palladium and platinum). The amalgam is preferably better than 99 weight percent pure and generally free of oxygen and water.

Various embodiments of the amalgam are preferably between 5-60 weight percent mercury, with 10-80 weight percent zinc, and 0.5-90 weight percent bismuth. Disclosed embodiments form rounder pellets with less mercury re-absorption than binary zinc-mercury amalgams. In a preferred embodiment, the composition range is 30-45 weight percent mercury, 35-60 weight percent zinc and 5-20 weight percent bismuth.

In a more preferred embodiment, the composition is approximately 45 weight percent mercury, approximately 41 weight percent zinc, and approximately 14 weight percent bismuth. One particularly preferred embodiment includes approximately 45 weight percent mercury, approximately 41.5 weight percent zinc, and approximately 13.5 weight percent bismuth. Solid and free flowing at room temperature, this composition is rounder than binary zinc-mercury amalgam.

In an alternatively preferred embodiment, the composition includes approximately 35 weight percent mercury, approximately 57 weight percent zinc, and approximately 8 weight percent bismuth. Another particularly preferred alternative embodiment of a bismuth-zinc-mercury composition includes approximately 35.2 weight percent mercury, approximately 57.0 weight percent zinc, and approximately 7.8 weight percent bismuth. It is free flowing and has excellent shape qualities when compared to binary zinc-mercury (50 weight percent mercury).

Adding bismuth to binary zinc-mercury amalgam does not significantly change their mercury vapor pressure. As discussed elsewhere, the bismuth-zinc-mercury amalgam retains a mercury vapor pressure substantially similar to the vapor pressure of pure mercury.

A description of the relevant phase diagrams indicates the insolubility of bismuth in mercury and in zinc. A binary bismuth-mercury phase diagram is a simple eutectic system with two solid phases that have no mutual solubility and that do not form intermetallic compounds. In the liquid phase, bismuth and mercury show one homogeneous liquid that extends from pure bismuth to pure mercury. Mixtures of bismuth and mercury all freeze at approximately −39.2° C.

Binary bismuth-zinc alloys also show little solubility in each other in the solid state. Zinc is slightly soluble in bismuth but little or no bismuth can be dissolved in zinc. No intermetallic compounds form between zinc and bismuth. These two metals form a miscibility gap in the liquid state. The miscibility gap extends from approximately 16 weight percent zinc to 98 weight percent zinc. Furthermore, it extends into the ternary bismuth-zinc-mercury system and creates a region that is generally impractical for pellet formation.

Bismuth-zinc amalgams have lower mercury contents than prior art amalgams (for example, zinc-mercury amalgams containing 50 weight percent zinc and 50 weight percent mercury) due to the addition of bismuth. Larger pellets may be needed to contain the same amount of mercury as a binary zinc-mercury amalgam containing 50 weight percent zinc and 50 weight percent mercury. In some of the presently disclosed embodiments, the Hg/Zn ratio is greater than 1.0. For prior art zinc-mercury amalgams, the Hg/Zn ratio is approximately 1.0.

Figure 2:
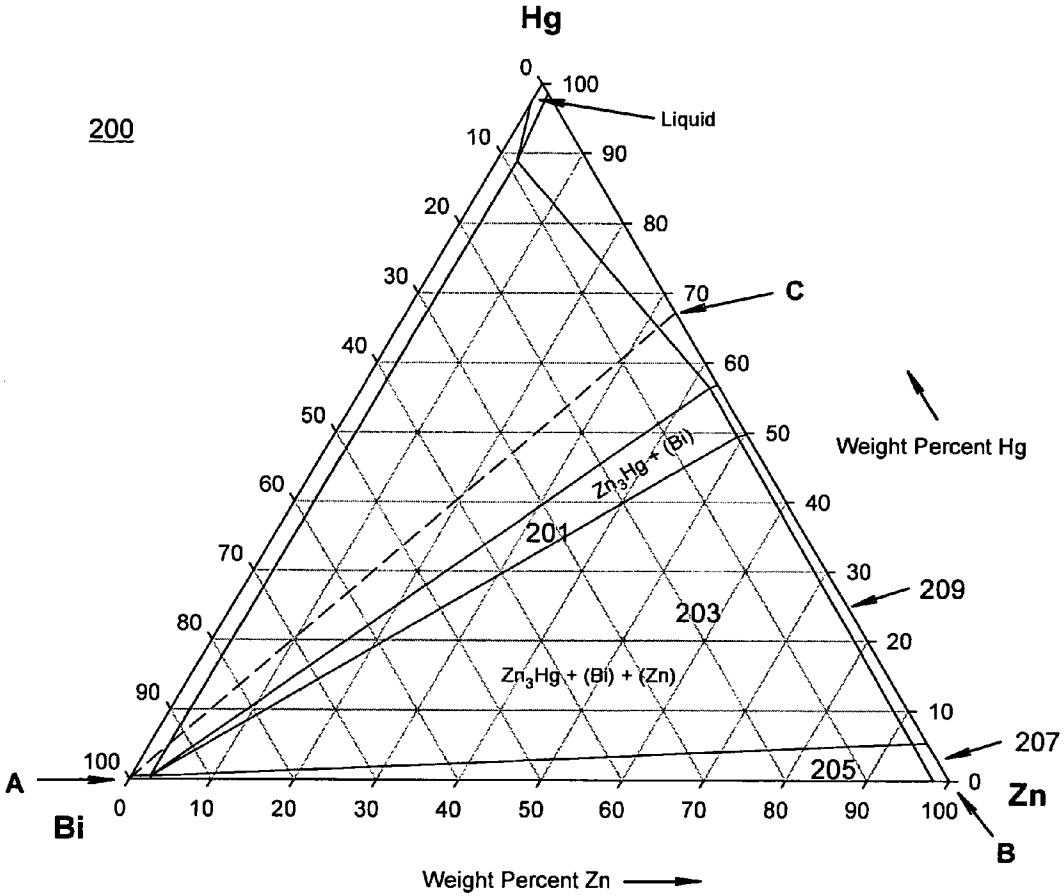
FIG. 2 illustrates a bismuth-zinc-mercury equilibrium phase diagram.

FIG. 2 is a bismuth-zinc-mercury equilibrium phase diagram at 20° C. As shown in phase diagram 200, the amalgams as presently disclosed are a solid at 20° C. and include bismuth solid solution, zinc solid solution, and the intermetallic compound $Zn_3Hg$. As discussed below, the amalgam may not have the predicted room temperature phases and may not be at equilibrium. The amalgam may be in a metastable, non-equilibrium state. P Bi—Zn—Hg pellets also advantageously dispense low amounts of mercury. This is due to the phase diagram construction illustrated in FIG. 2. A two-phase band 201 of solid $Zn_3Hg$ and bismuth solid solution extends from almost pure bismuth to 50 weight percent mercury (pure $Zn_3Hg$). Amalgams with low mercury content (for example, 15 weight percent mercury and below) are readily manufactured (for example, using the method disclosed by Anderson) and have low total mercury amounts. Example 3, described in detail elsewhere, illustrates a material with a large diameter and low mercury content. The pellet in the example contained about 2.2 mg mercury and had a diameter of approximately 1.5 mm. The low end of the mercury content in a practical application can be as low as 0.1 mg mercury in approximately a 1.5 mm pellet. In fact, the mercury content of any pellet of this sort (Zn—Bi—Hg) can be made arbitrarily low.

FIG. 2 also shows a three-phase triangle 203 comprised of zinc solid solution, bismuth solid solution, and $Zn_3Hg$. This region includes lower mercury content. Materials in this three-phase region may also be produced by the method of Anderson or other suitable production methods. They may have low mercury content and be suitable for applications where low mercury content is desirable. In both cases, the mercury content and the pellet diameter are independently adjustable and are optionally used to obtain a desirable diameter and mercury content.

FIG. 2 also shows a two-phase region 205 existing between zinc solid solution and bismuth solid solution. This region 205 is even lower in mercury content. Mercury content in this region 205 ranges from approximately 0.4 weight percent at nearly pure bismuth to approximately 5.5 weight percent mercury near pure zinc. Low bismuth regions 207, 209 have varying mercury contents.

Because the amalgam is a solid at room temperature, the amount of amalgam that is to be introduced into a lamp may be easily quantified and dispensed. For example, small pellets of generally uniform mass and composition may be formed with any shape that is appropriate for the manufacturing process, although spherical and substantially spherical pellets are the most easily handled. Pellet diameters are desirably between about 200 to 3000 microns.

In various embodiments, spherical and substantially spherical pellets of generally uniform mass and composition are made by rapidly solidifying or quenching the amalgam melt. Exemplary apparatus and processes are disclosed in U.S. Pat. No. 4,216,178 (Anderson), issued Aug. 5, 1980, the entire disclosure of which is incorporated herein by reference.

Features and advantages of various disclosed embodiments are illustrated in greater detail in the following examples:

Example 1

13.3 grams of bismuth pellets, 40.2 grams of zinc pellets and 46.5 grams of liquid mercury were melted and pelletized by the method disclosed in Anderson. Eighty-one of these pellets were subjected to a weight loss experiment. Mercury was released from these pellets at 325° C. for 1 hour under a vacuum of about 0.3 Torr. The pellets were weighed before and after the weight loss experiment and the difference in weight was measured. The percent change in mass was then calculated. The average weight loss from 81 ternary bismuth-zinc-mercury pellets was 45.3 weight percent.

Example 2

Figure 3:
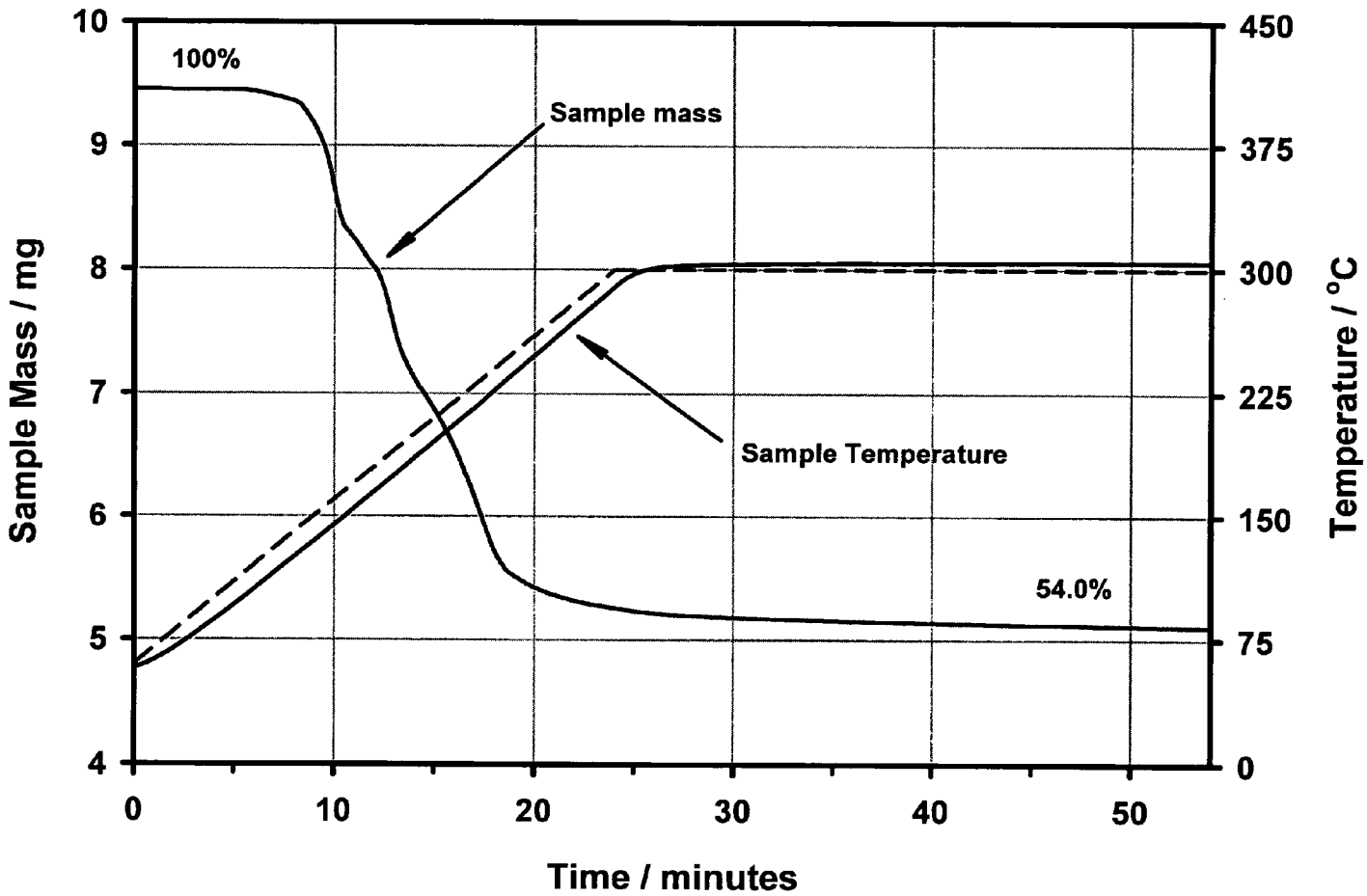
FIG. 3 illustrates a weight loss curve from an individual bismuth-zinc-mercury amalgam pellet.

A single ternary amalgam pellet comprised of bismuth, zinc, and mercury in the amounts of Example 1 was placed in a thermogravimetric analyzer to record the mercury loss with time. The amalgam pellet was heated to 300° C. and purged with argon gas at a pressure of 1.8 Torr. The pellet weight was recorded. It had an initial weight of 9.451 mg and a final weight of 5.105 mg. The weight loss was 4.346 mg and the percent change in weigh was 46.0 percent. FIG. 3 shows the weight loss curve from an individual bismuth-zinc-mercury amalgam pellet. In particular, FIG. 3 illustrates the mercury evolution rate from a single bismuth zinc amalgam pellet at 300° C. and 1.8 Torr of argon pressure.

Example 3

76 grams of bismuth pellets, 12 grams of zinc pellets, and 13 grams of liquid mercury were melted and pelletized by the method disclosed in Anderson. A single pellet of this composition was placed in a thermogravimetric analyzer. The amalgam pellet was heated to 300° C. and purged with argon gas at a pressure of 1.8 Torr. The pellet weight was recorded. It had an initial weight of 17.553 mg and a final weight of 15.33 mg. The weight loss was 2.223 mg and the weight loss percentage was 12.6 percent.

Example 4

57.0 g of zinc shot, 7.8 g of bismuth pellets and 35.2 g of mercury were melted and pelletized by the method disclosed in Anderson. Several pellets of this composition were crushed and placed in a thermostated cell. The cell was heated and mercury vapor was emitted from the pellet. The absorbance of the mercury vapor was measured and used to calculate its mercury vapor pressure. The results are shown in FIG. 4.

Figure 4:
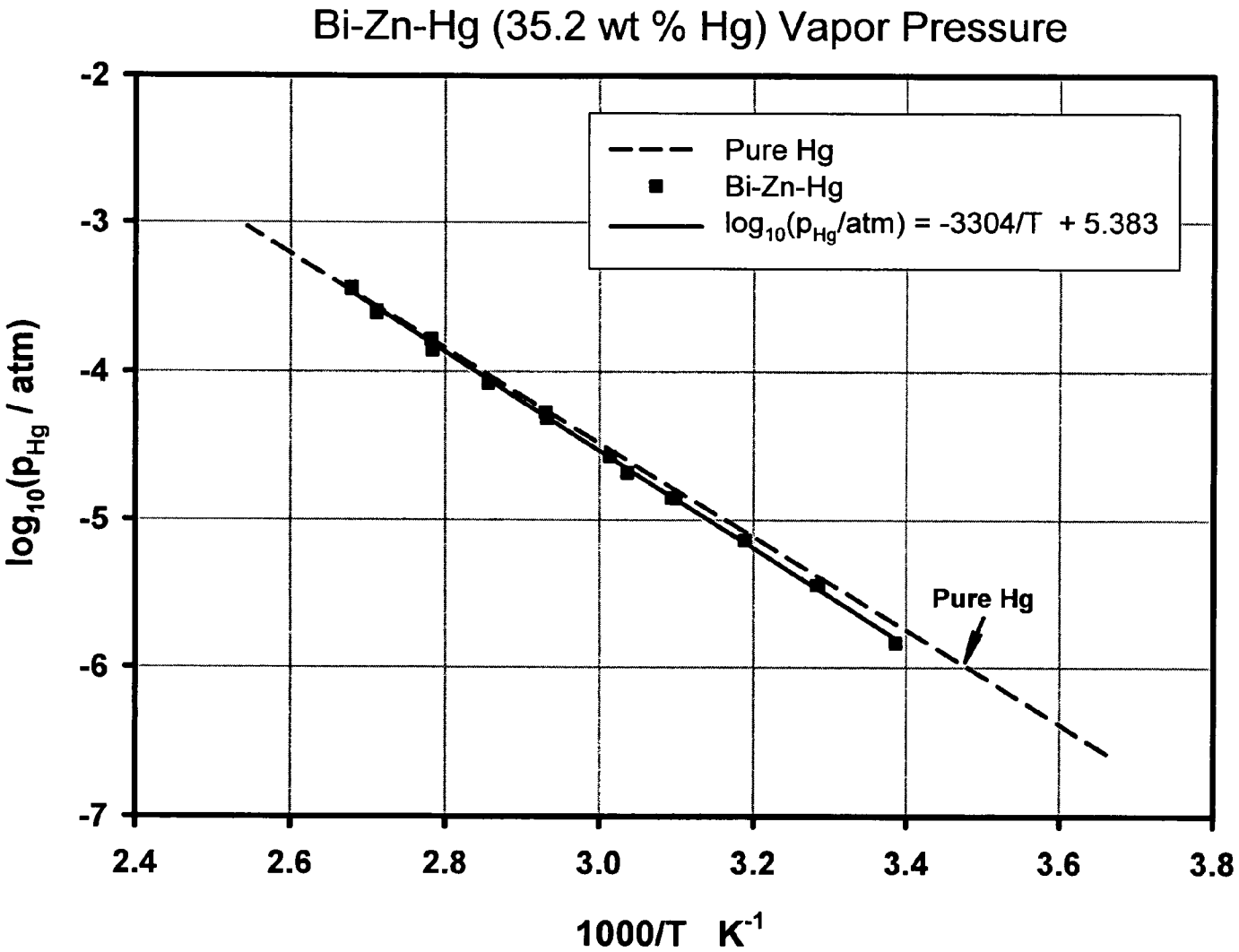
FIG. 4 illustrates the mercury vapor pressure above a bismuth-zinc amalgam.

FIG. 4 illustrates the mercury vapor pressure above a bismuth-zinc amalgam containing 57.0 weight percent zinc, 7.8 weight percent bismuth, and 35.2 weight percent mercury. The mercury vapor pressure is plotted as a function of inverse temperature. A comparison to the literature values of pure mercury are shown for reference. The vapor pressure of the material is nearly identical to the vapor pressure of pure mercury. These pellets are free flowing at room temperature.

Figure 5:
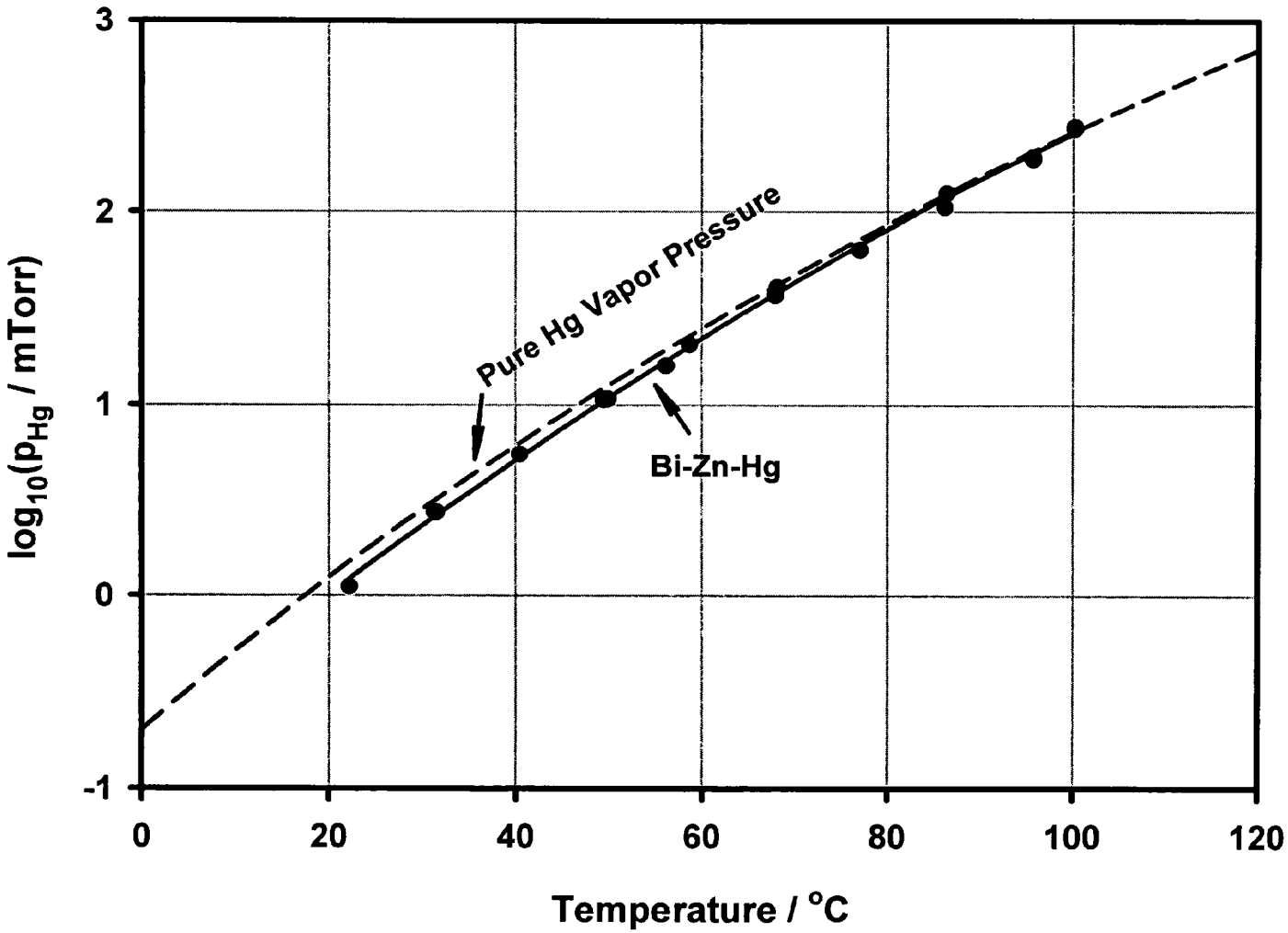
FIG. 5 is a graph of the mercury vapor pressure of the bismuth-zinc amalgam of FIG. 4.

FIG. 5 is a graph of the mercury vapor pressure of the same bismuth-zinc amalgam given in FIG. 4. The mercury vapor pressure is plotted as a function of temperature on a linear scale ($\log(p_{Bi-Zn-Hg})$ vs. T° C.). Literature values of pure mercury are shown for reference.

These processes can be used to manufacture spherical or substantially spherical pellets of predetermined and uniform mass (±15%) in the range from 0.25-125 milligrams. Other suitable techniques for making the pellets, such as die casting or extrusion, may be used. Using existing devices and suitable techniques, the pellets may be weighed, counted or measured volumetrically and introduced into the lamp. For example, a lamp that requires 9 mg of mercury may use 2 pellets, each containing 45 weight percent mercury and each weighing 10 mg.

U.S. Pat. No. 5,882,237 describes the microstructure of rapidly solidified binary zinc-mercury amalgams. Binary zinc-mercury amalgams have a metastable, non-equilibrium structure. Ternary bismuth-zinc amalgam pellets manufactured by the rapid solidification or quenching processes discussed above also have a structure that is different from that obtained by equilibrium freezing. In particular, they do not necessarily melt or freeze in accordance with the published bismuth-zinc-mercury phase diagram. Bismuth-zinc-mercury amalgam pellets produced by the method disclosed in Anderson show a metastable microstructure. Four phases are present: zinc solid solution, bismuth, $Zn_3Hg$ (γ phase), and a mercury-rich intergranular phase.

Zinc solid solution is present and is concentrated near the perimeter of the pellet. This results from non-equilibrium solidification for an amalgam containing 45 weight percent mercury and 13.3 weight percent bismuth. An equilibrium microstructure would consist only of $Zn_3Hg$ and bismuth. A mercury-rich phase is also present and is concentrated in the interior regions of the pellet. This results from the non-equilibrium solidification found in the presently disclosed embodiments. The mercury-rich phase is primarily found in the intergranular regions of bismuth-zinc amalgams.

The equilibrium phases, bismuth and $Zn_3Hg$ are uniformly spread throughout the pellet. Pellet with compositions high in bismuth, compositions near point A (of FIG. 2, corresponding to pure Bi) in FIG. 3, will have a predominance of bismuth, and pellets with compositions high in zinc and mercury will have large amounts of $Zn_3Hg$.

The composition of bismuth-zinc amalgams can also be understood by a triangle formed between pure bismuth, Bi, point A, pure Zn, point B (of FIG. 2, corresponding to pure Zn), and point C (of FIG. 2, corresponding to 67 weight percent Hg, 33 weight percent Zn), a zinc-mercury binary amalgam containing approximately 32.8 atomic percent (60 weight percent) mercury.

Table I reflects eccentricity measurements for 46 bismuth-zinc-mercury pellets. They are compared to zinc-mercury (50 weight percent mercury). Bismuth-zinc-mercury pellets are substantially rounder than zinc-mercury pellets. A side-by-side comparison of bismuth-zinc-mercury pellets with zinc-mercury pellets qualitatively indicates that Zn—Bi—Hg pellets are rounder than Zn—Hg pellets:

TABLE I

| Material | No. | Average Major Axis/μm | Average Minor Axis/μm | Eccentricity | Equivalent Sphere Diameter/μm |
|---|---|---|---|---|---|
| Zn—Bi—Hg | | | | | |
| Average | 46 | 1236 | 1219 | 1.015 | 1224 |
| Std. Dev. (1σ) | | 18 | 20 | 0.009 | 18 |
| Zn—Hg | | | | | |
| Average | 35 | 1353 | 1286 | 1.052 | 1307 |
| Std. Dev. (1σ) | | 38 | 37 | 0.033 | 31 |

In another embodiment, a spherical amalgam pellet including zinc and at least one other amalgamative metal (including, but not limited to bismuth) with no more than approximately 15 weight percent mercury has a diameter greater than about 0.5 mm. In alternative preferred embodiments, the pellet has no more than approximately 5 or 1 weight percent mercury to provide a low mercury dose. In other alternative embodiments, the diameter is greater than approximately 1 mm, 1.5 mm, or 1.2-1.7 mm. These pellets advantageously provide a low mercury dose in a relatively large pellet which is easier to arrange, trap, or attach at a particular position within a lamp.

While preferred embodiments have been described, it is to be understood that the embodiments described are illustrative only and the scope of the disclosed embodiments is to be defined solely by the appended claims when accorded a full range of equivalence, many variations and modifications naturally occurring to those skilled in the art from a perusal hereof.

The invention claimed is:

1. A pellet having a microstructure comprising a bismuth solid solution phase, a zinc solid solution phase, and a $Zn_3Hg$ phase, said pellet comprising about 45 weight percent mercury, about 13.5 weight percent bismuth, and about 41.5 weight percent zinc.

2. A pellet having a microstructure comprising a bismuth solid solution phase, a zinc solid solution phase, and a $Zn_3Hg$ phase, said pellet comprising about 35 weight percent mercury, about 8 weight percent bismuth, and about 57 weight percent zinc.

3. A pellet having a microstructure comprising a bismuth solid solution phase, a zinc solid solution phase, and a $Zn_3Hg$ phase, said pellet comprising approximately 45 weight percent mercury, approximately 41 weight percent zinc, and approximately 14 weight percent bismuth.

4. A pellet having a microstructure comprising a bismuth solid solution phase, a zinc solid solution phase, and a $Zn_3Hg$ phase, said pellet comprising approximately, 45 weight percent mercury, approximately 41.5 weight percent zinc, and approximately 13.5 weight percent bismuth.

5. A pellet having a microstructure comprising a bismuth solid solution phase, a zinc solid solution phase, and a $Zn_3Hg$ phase, said pellet comprising approximately 35 weight percent mercury, approximately 57 weight percent zinc, and approximately 8 weight percent bismuth.

6. A pellet having a microstructure comprising a bismuth solid solution phase, a zinc solid solution phase, and a $Zn_3Hg$ phase, said pellet comprising approximately 35 weight percent mercury, approximately 57 weight percent zinc, and approximately 7.8 weight percent bismuth.

7. A pellet comprising bismuth, zinc, and mercury wherein the bismuth, zinc, and mercury are present only in a bismuth solid solution phase and a $Zn_3Hg$ phase, said phases being substantially uniformly distributed in the pellet.

8. The pellet of claim 7 wherein said pellet is substantially spherical.

* * * * *